US007018300B2

(12) United States Patent
Paicos

(10) Patent No.: US 7,018,300 B2
(45) Date of Patent: Mar. 28, 2006

(54) AUTOMATIC GOLF BALL TEEING UP DEVICE

(76) Inventor: Christopher Peter Paicos, 289 Kendall Rd., Tewksbury, MA (US) 01876

( * ) Notice: Subject to any disclaimer, the term of this patent is extended or adjusted under 35 U.S.C. 154(b) by 349 days.

(21) Appl. No.: 10/752,206

(22) Filed: Jan. 6, 2004

(65) Prior Publication Data

US 2004/0259652 A1 Dec. 23, 2004

Related U.S. Application Data

(60) Provisional application No. 60/479,038, filed on Jun. 18, 2003.

(51) Int. Cl.
*A63B 57/00* (2006.01)

(52) U.S. Cl. ..... 473/135

(58) Field of Classification Search ..... 473/132–137
See application file for complete search history.

(56) References Cited

U.S. PATENT DOCUMENTS 2,696,985 A * 12/1954 Hogeberg ..... 473/136
4,181,309 A * 1/1980 Atkinson et al. ..... 473/136
5,052,688 A * 10/1991 Shiau ..... 473/135
5,282,629 A * 2/1994 Eckstein ..... 473/133
5,356,148 A * 10/1994 Elder, Jr. ..... 473/133
5,603,664 A 2/1997 Provost ..... 473/134
5,662,526 A * 9/1997 Sutherlin ..... 473/135
5,916,033 A * 6/1999 Doherty ..... 473/135

* cited by examiner

*Primary Examiner*—Steven Wong
(74) *Attorney, Agent, or Firm*—Law Offices of J. D. Beraigery, P.C.; Janine D. Geraigery

(57) ABSTRACT

An automatic golf ball teeing up device for use by a golfer at driving ranges, and other facilities. The teeing up device includes a pair of holding cylinders, a pneumatic cylinder, and a photoelectric sensor in communication with a timer and relay. A holding cage and tube gravity feed golf balls one at a time past the holding cylinders into a loading chamber. The pneumatic cylinder has a piston rod having a tee thereon, which extends upwardly through the loading chamber to tee up the golf ball. The photoelectric sensor has a photoelectric eye and reflector axially aligned with the teed up golf ball therebetween. When the golf ball is removed from the tee, the photoelectric eye and reflector connect to signal the timer and relay to actuate the holding cylinders and pneumatic cylinder to feed and tee another golf ball.

18 Claims, 5 Drawing Sheets

AUTOMATIC GOLF BALL TEEING UP DEVICE

CROSS REFERENCES AND RELATED SUBJECT MATTER

The application relates to subject matter contained in provisional patent application Ser. No. 60/479,038 filed in the United States Patent Office on Jun. 18, 2003.

BACKGROUND OF THE INVENTION

The invention relates to a golf ball teeing up device, and more particularly, to an automatic golf ball teeing up device for teeing up a golf ball so that the golfer does not have to bend over and tee the ball after each swing.

Golfing is a pastime enjoyed by many Americans. Whether it is playing golf competitively or just for leisure, Americans continue to invest much time, energy, and money into joining golf clubs, taking golf lessons, and practicing their swing at driving ranges. Golfing offers its players the advantage of moderate exercise, while spending time outdoors enjoying beautifully groomed courses. In addition, swinging the many different clubs, carrying the bag of golf clubs, and walking the golf course also provide players with moderate levels of physical fitness. Many avid golfers enjoy spending time at driving ranges where they can practice their swing over and over again. At such facilities, a player usually purchases a bucket of golf balls and hits them one at a time off of the tee into a large fenced-in landscape. In between each swing, the golfer must bend over, retrieve another golf ball, and properly set it on the tee. This action causes the golfer to move their feet and take their hands off of the golf club, and for each swing the golfer must then re-grip their club and readjust their stance.

U.S. Pat. No. 5,603,664 to Provost discloses a golf ball teeing-up apparatus that has a detector underneath the tee for detecting the presence of a golf ball on the tee to tee-up another golf ball when needed. U.S. Pat. No. 5,356,148 to Elder, Jr. discloses a mechanism for automatically teeing practice golf balls, using a manually operated switch which causes the teeing mechanism to retract and receive another golf ball. U.S. Pat. No. 5,916,033 to Doherty discloses a golf ball teeing-up device that has a control switch that is manually tapped by a golf club sole to initiate the teeing-up.

While these units may be suitable for the particular purpose employed, or for general use, they would not to be as suitable for the purposes of the present invention as disclosed hereafter.

SUMMARY OF THE INVENTION

It is an object of the invention to produce an improved simple and convenient means of automatically teeing up a golf ball so that the golfer does not have to bend over and tee the ball after each swing. Accordingly, the invention is a automatic golf ball teeing up device of the present invention having a pneumatic cylinder device and photoelectric sensor device, for simply and conveniently teeing up a golf ball.

It is another object of the invention to provide a no-touch fully automatic golf ball teeing up device. Accordingly, the photoelectric sensor device of the present invention has a photoelectric eye axially aligned with a reflector for sensing the absence of a golf ball therebetween and automatically teeing up another golf ball.

It is another object of the invention to provide an improved mechanism for prohibiting golf balls from passing through the holding cage and into the tube. Accordingly, the invention has a pair of solenoid valves within a pair of holding cylinders which alternate energizing and de-energizing to prohibit golf balls from freely passing and allowing one golf ball to pass therethrough and be teed up at a time.

It is another object of the invention to provide an easy means for feeding golf balls into an automatic teeing up device. Accordingly, the invention has a holding cage having an opening which easily feeds a plurality of golf balls in a single file line into the tube.

This invention is an automatic golf ball teeing up device for use by a golfer at driving ranges, and other facilities. The teeing up device includes a pair of holding cylinders, a pneumatic cylinder, and a photoelectric sensor in communication with a timer and relay. A holding cage and tube gravity feed golf balls one at a time past the holding cylinders into a loading chamber. The pneumatic cylinder has a piston rod having a tee thereon, which extends upwardly through the loading chamber to tee up the golf ball. The photoelectric sensor has a photoelectric eye and reflector axially aligned with the teed up golf ball therebetween. When the golf ball is removed from the tee, the photoelectric eye and reflector connect to signal the timer and relay to actuate the holding cylinders and pneumatic cylinder to feed and tee another golf ball.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
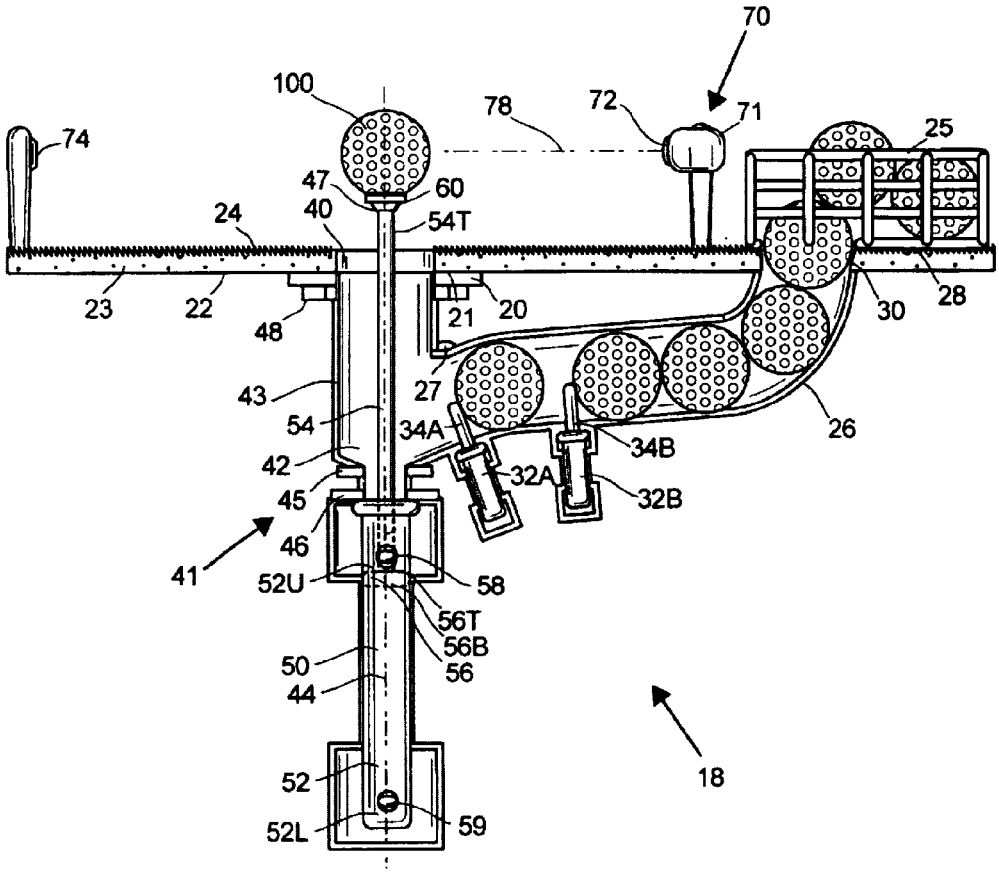
FIG. 1 is a vertical cross-sectional view of the automatic golf ball teeing up device of the present invention having a pneumatic cylinder device and photoelectric sensor device, for automatically teeing up a golf ball.

FIG. 1 illustrates an automatic golf ball teeing up device 18 for simply and conveniently teeing up a golf ball at a driving range or golf course, or similar facility, so that a golfer does not have to bend over and tee the golf ball after each swing. The driving range has a playing green having a foundation 23 just above a ground level 22. Artificial turf 24 is positioned on top of the foundation 23.

A rectangular base plate 20 has a top surface 21 which lies horizontally below the foundation 23. An artificial turf 24 is attached to the foundation 23. A circular cutout 40 extends through the artificial turf 24, foundation 23, and rectangular base plate 20. A chamber assembly 41 having a cylindrical chamber 43 extends downwardly from the circular cutout 40, perpendicular to the rectangular base plate 20. A locknut 48 attaches the cylindrical chamber 43 to the rectangular base plate 20. The cylindrical chamber 43 has a loading chamber 42 therein, and a retainer ring 45 extending therein. The retainer ring 45 holds one golf ball at a time thereon prior to being teed up.

A holding cage 25, for holding a plurality of golf balls therein, includes a bottom surface 28. The bottom surface 28 of the holding cage 25 has an opening 30 which rests against the foundation 23 or artificial turf 24. A tube 26, preferably a polyvinyl chloride tube, is attached to the opening 30 at the bottom surface 28 of the holding cage 25 and extends downwardly at a slight incline through the cylindrical chamber 43 and into the loading chamber 42. The tube 26 is welded into the cylindrical chamber 43, preferably using a polyvinyl chloride weld 27. The tube 26 is slightly larger in diameter than a golf ball for holding the golf balls in a single file line therein. The tube 26 gravity feeds the golf balls from the holding cage 26 in a single file line one at a time down onto the retainer ring 45 within the loading chamber 42.

A pair of holding cylinders 32, including a first holding cylinder 32A and a second holding cylinder 32B, bisect the tube 26 and are used to hold back the golf balls within said tube 26 so that the golf balls back up behind one another and are only allowed to pass into the loading chamber 42 one at a time. Each holding cylinder 32A and 32B includes a solenoid valve 34, including a first and second solenoid valve 34A and 34B, for controlling up and down movements of the holding cylinders 32. Preferably, the holding cylinders 32 are driven by compressed air and threaded into the tube 26 one and three-fourths inches apart. Working opposite one another, the holding cylinders 32 allow only one golf ball to pass at a time.

The chamber assembly 41 includes a vertical axis 44. A pneumatic cylinder device 50 fits within the cylindrical chamber 43. A circular base cap 46 holds the pneumatic cylinder device 50 axially aligned along the vertical axis 44 of the chamber assembly 41. The golf ball in position on the retainer ring 45 is axially aligned along the vertical axis 44. The pneumatic cylinder device 50 has a main cylinder 52 having a piston rod 54 mounted therein and a piston head 56. Preferably, the main cylinder 52 is driven by compressed air. The piston rod 54 includes a top end 54T, and is raised and lowered in a telescoping manner from within the main cylinder 52. The main cylinder 52 of the pneumatic cylinder device 50 has an upper end 52U and a lower end 52L. The piston head 56 has a top side 56T and a bottom side 56B. A down port 58 and an up port 59 extend outwardly from the upper end 52U and the lower end 52L respectively. The down and up ports 58 and 59 supply compressed air pressure, preferably through plastic tubing, to the top and bottom sides 56T and 56B of the piston head 56. The main cylinder 52 is substantially air tight so that when air pressure is increased through the upper end 52U on the top side 56T of the piston head 56, said piston head 56 is forced downwardly thereby withdrawing the piston rod 54 into the loading chamber 42 and into the main cylinder 52. When air pressure is increased through the lower end 52L on the bottom side 56B of the piston head 56, said piston head 56 is raised thereby extending the piston rod 54 upwardly through the loading chamber 42 and the circular cutout 40. The down port 58 is connected, preferably by plastic tubing, to the second: solenoid valve 34B within the second holding cylinder 32B. The up port 59 is connected, preferably by plastic tubing, to the first solenoid valve 34A within the first holding cylinder 32A.

A tee 60 is attached to the top end 54T of the piston rod 54. A bolt is fitted within the tee 60 and is attached to an attaching nut 47. The attaching nut 47 is then fitted onto a coupling and onto the top end 54T of the piston rod 54. The tee 60 is preferably made of rubber.

Figure 4:
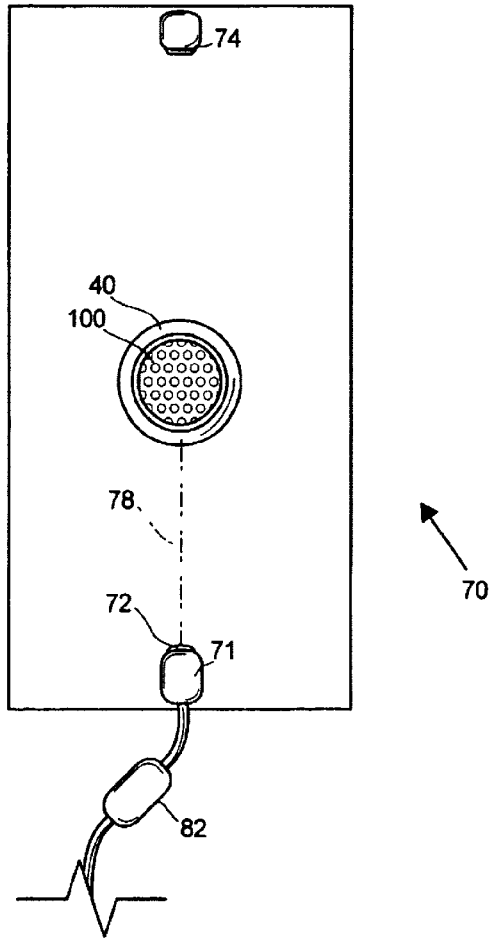
FIG. 4 is a top plan view of the photoelectric sensor device of the present invention, having a photoelectric eye axially aligned with a reflector, and including a teed up golf ball position therebetween along the axis.
Figure 5:
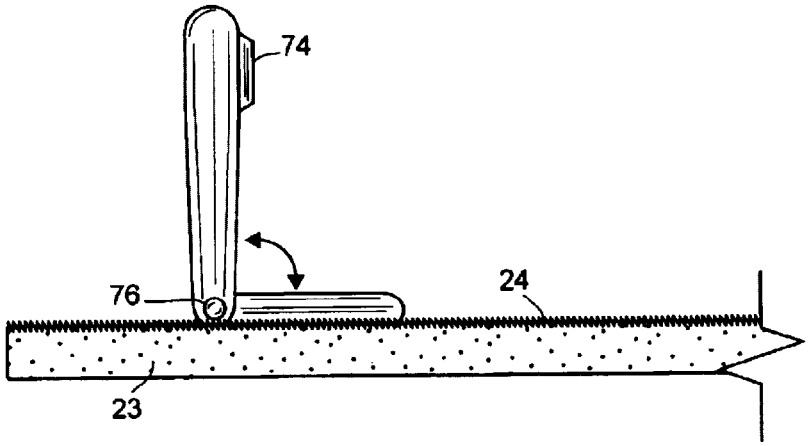
FIG. 5 illustrates the reflector of the photoelectric sensor device of the present invention having a spring loaded hinge.
Figure 6:
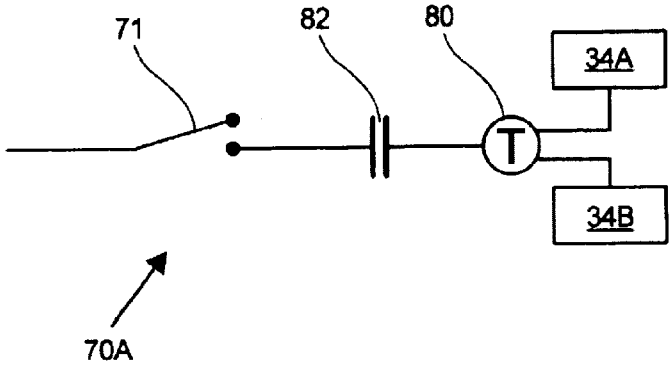
FIG. 6 is a diagrammatic view of the photoelectric sensor device of the present invention, having a sensor switch, a relay, and a timer, connected to the first and second solenoid valve of the first and second holding cylinders.

A photoelectric sensor device 70 has a photoelectric sensor 71 having a photoelectric eye 72 and a reflector 74, the photoelectric sensor 71 is in communication with a timer 80 and a relay 82, shown in FIGS. 4 and 6. An electrical circuit 70A is illustrated including electronically connecting the photoelectric sensor 71, the relay 82, timer 80, and the first and second solenoid valves 34A and 34B are shown in FIG. 6. In FIG. 1, the photoelectric eye 72 is mounted to the foundation 23. The reflector 74 is attached by a spring loaded hinge 76 to the foundation 23 near or on the artificial turf 24, shown in FIG. 5. The photoelectric eye 72 is axially aligned along an axis 78 with the reflector 74 as shown in FIG. 4. The photoelectric eye 72, of the photoelectric sensor 71 connects in communication with the reflector 74 along the axis 78. The golf ball 100 on the tee extends upwardly through the circular cutout 40 along the axis 78 between the photoelectric eye 72 and the reflector 74, illustrated in FIG. 4. When the golf ball 100 is in position on the tee the photoelectric eye 72 is interrupted, or no longer connected to the reflector 74, shown in FIG. 4, causing the relay to reset the timer. Interrupting the photoelectric eye 72 allows the photoelectric sensor 71 to sense the presence of the golf ball 100 on the tee. Once the golfer takes a swing and hits the golf ball 100 off of the tee, the photoelectric eye 72 of the photoelectric sensor 71 connects with the reflector 74, and the photoelectric sensor 71 then triggers the timer from the absence of a teed up golf ball.

Figure 2:
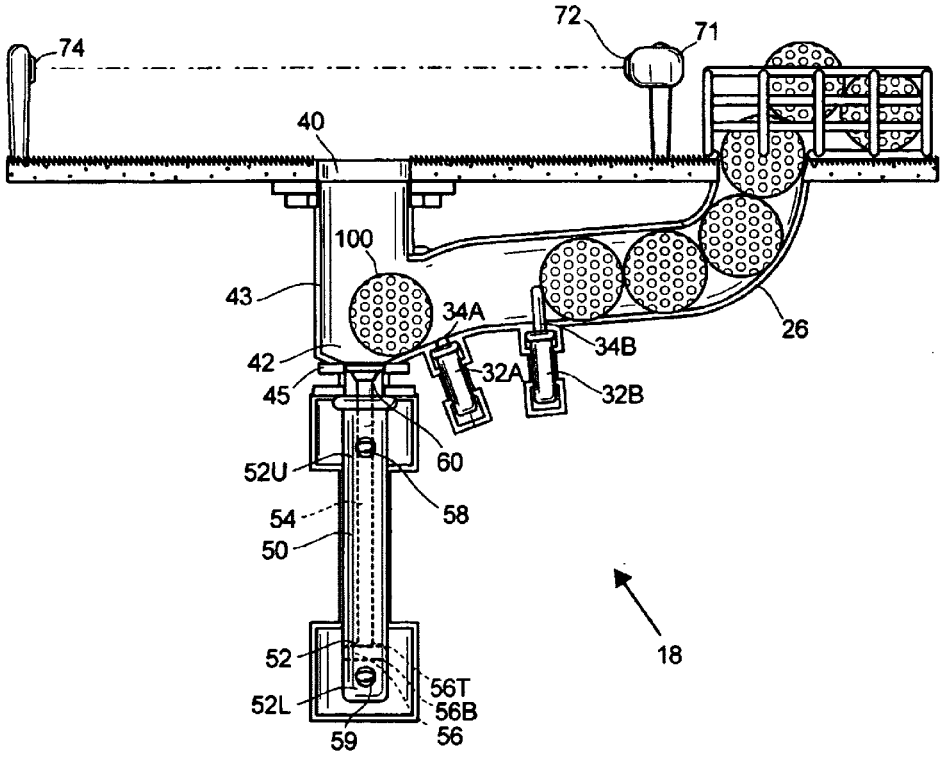
FIG. 2 is a vertical cross-sectional view of the automatic golf ball teeing up device of the present invention shown in use in the down stroke position.
Figure 3:
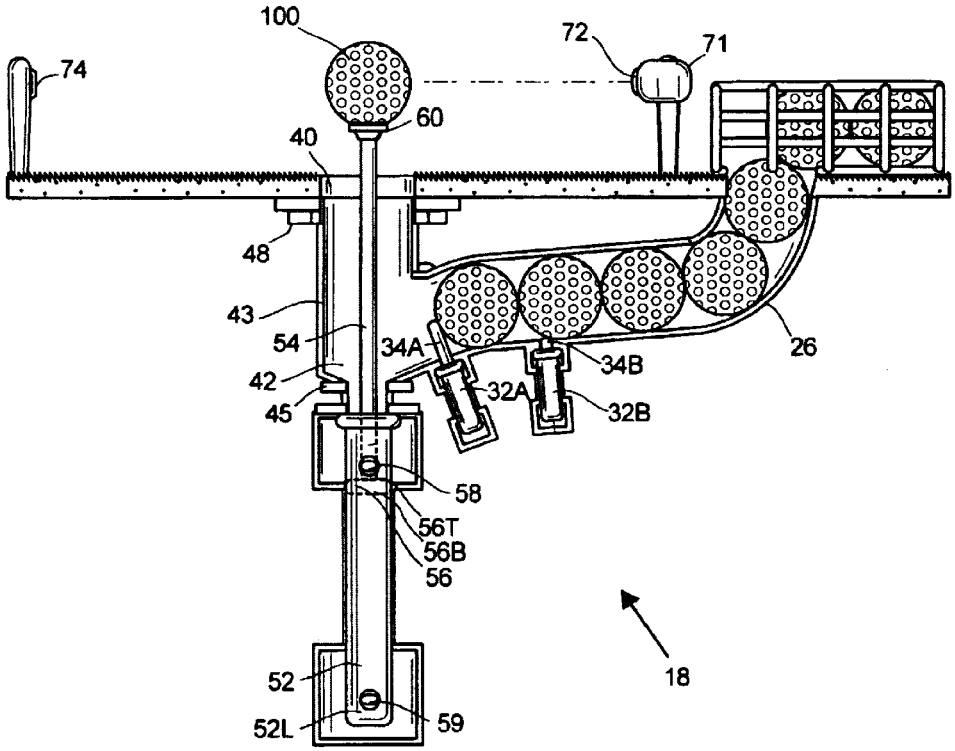
FIG. 3 is a vertical cross-sectional view of the automatic golf ball teeing up device of the present invention shown in use in the up stroke position.

FIGS. 2 and 3 illustrate the teeing up device 18 for the invention in use wherein pair of solenoid valves within the pair of holding cylinders alternate energizing and de-energizing to allow one golf ball to pass therethrough and be teed up at a time. FIG. 2 illustrates the photoelectric sensor 71 being triggered with the photoelectric eye 72 connects with the reflector 74 and causes a down stroke position to be actuated. The golf ball 100, which originated in the holding cage and traveled downwardly through the tube 26, is positioned between the first and second holding cylinders 32A and 32B. The timer 80 and relay 82, shown in FIG. 5, control the pair of solenoid valves within the holding cylinders, which in turn are connected to the down and up ports 58 and 59 within the chamber assembly 41. The relay 82 is used to isolate and reset the timer 80 as shown in FIG. 5. Further referring to FIG. 5, then the photoelectric eye 72 connects with the reflector 74, the photoelectric sensor 71 is triggered and the timer 80 is actuated by the relay 82 and energizes the first solenoid valve 34A in the first holding cylinder to be pulled inwardly into the first holding cylinder in a down stroke. In FIG. 2, when this occurs air pressure is increased on the top side 56T of the piston head 56 by traveling into the down port 58 on the lower end 52L of the main cylinder 52. This forces the piston head 56 downwardly thereby withdrawing the piston rod 54 into the loading chamber 42 and into the main cylinder 52. Then, the timer 80 counts for 1.6 seconds in order to allow the golf ball 100 to roll from the tube 26 into loading chamber 42 of the cylindrical chamber 43 and onto the retainer ring 45.

After 1.6 seconds, the timer 80 de-energizes the first solenoid valve 34A, and energizes the second solenoid valve 34B thereby causing an up stroke position to be actuated, shown in FIG. 3. Here, the second solenoid valve 34B is energized and pushes downwardly into the second holding cylinder 32B in a down stroke, thereby allowing the golf balls within the tube 26 to pass. However, because the first solenoid valve 34A is moved upwardly, the plurality of golf balls within the tube 26 are stopped and prohibited from passing the first solenoid valve 34A. Once energized, the second solenoid valve 34B, connected to the up port 59, causes air pressure to increase through the up port 59 on the lower end 52L of the main cylinder 52, to the bottom side 56B of the piston head 56. The piston head 56 is raised thereby extending the piston rod 54 upwardly through the loading chamber 42 and the circular cutout 40. The piston rod 54, with tee 60 attached thereto, raises up through the loading chamber 42, through the retainer ring 45 and pushes the golf ball 100 on the retainer ring 45 upwardly therewith, thereby teeing up the golf ball 100. Once the photoelectric sensor 71 is disrupted by the photoelectric eye 72 no longer connecting with the reflector 74, the photoelectric sensor 71 triggers the relay to reset the timer.

In conclusion, herein is presented an automatic golf ball teeing up device. The invention is illustrated by example in the drawing figures, and throughout the written description. It should be understood that numerous variations are possible, while adhering to the inventive concept. Such variations are contemplated as being a part of the present invention.

What is claimed is:

1. An automatic golf ball teeing up device for use by a golfer to automatically tee a golf ball, on a playing green having a foundation above a ground level, comprising:

an artificial turf coupled to the foundation;

a rectangular base plate having a top surface that lies below the foundation;

a circular cutout extending through the artificial turf, foundation, and rectangular base plate;

a chamber assembly having a vertical axis and a cylindrical chamber attached to the rectangular base plate having a loading chamber and retainer ring, the cylindrical chamber extending downwardly from the circular cutout perpendicular to the rectangular base plate, the retainer ring for holding one golf ball along the vertical axis prior to being teed up;

a holding cage for holding a plurality of golf balls therein, having a bottom surface having an opening which rests against the foundation;

a tube attached to the opening of the bottom surface of the holding cage and extending downwardly at an incline into the loading chamber of the cylindrical chamber for holding golf balls in a single file line to gravity feed the golf balls one at a time onto the retainer ring;

a pair of holding cylinders, including a first and second holding cylinder, each having a solenoid valve, including a first and second solenoid valve, for controlling up and down movements of the holding cylinders by energizing and de-energizing, said holding cylinders bisect the tube and work opposite one another to allow one golf ball to pass at a time, holding back the golf balls stacked within said tube;

a pneumatic cylinder device axially aligned along the vertical axis of the chamber assembly within the cylindrical chamber by a circular base cap, having a main cylinder substantially air tight and having an upper end and a lower end, having a piston rod and piston head mounted within the main cylinder, the piston rod having a top end and being raised and lowered in a telescoping manner from within the main cylinder, the piston head having a top side and a bottom side, the main cylinder having a down port extending outwardly from the upper end, and an up port extend outwardly from the lower end thereof, the down port being connected to the second solenoid valve within the second holding cylinder, and the up port being connected to the first solenoid valve within the first holding cylinder, the down and up ports supply compressed air pressure to the top and bottom sides of the piston head within the main cylinder;

a tee attached to the top end of the piston rod by a bolt coupled to an attaching nut, the attaching nut being fitted onto a coupling and onto the top end of the piston rod; and a photoelectric sensor device having a photoelectric sensor having a photoelectric eye and a reflector, said photoelectric sensor in communication with a timer and a relay for electrically controlling the solenoid valves within the holding cylinders and the piston rod within the main cylinders, the photoelectric eye being mounted to the foundation, the reflector being attached by a spring loaded hinge to the foundation, the photoelectric eye being aligned along an axis in communication with the reflector, the tee extending upwardly through the circular cutout along the axis between the photoelectric eye and the reflector, the photoelectric sensor being triggered when the photoelectric eye connects with the reflector, causing the timer to be actuated and energizing the first solenoid valve in the first holding cylinder to be pulled inwardly into the first holding cylinder in a down stroke, which causes air pressure to increase on the top side of the piston head by traveling into the down port on the lower end of the main cylinder to force the piston head downwardly thereby withdrawing the piston rod into the main cylinder, the timer counts for a plurality of seconds allowing one golf ball to roll from the tube onto the retainer ring, then the timer de-energizes the first solenoid valve, and energizes the second solenoid valve thereby causing an up stroke position to be actuated by the first solenoid valve, while the second solenoid valve pushes downwardly into the second holding cylinder in a down stroke the first solenoid valve is moved upwardly to hold back the golf balls, once energized the second solenoid valve causes air pressure to increase through the up port on the lower end of the main cylinder to the bottom side of the piston head, the piston head being raised thereby extending the piston rod upwardly through the circular cutout for teeing the golf ball, the photoelectric sensor being disrupted by the photoelectric eye disconnecting from the reflector causing the relay to be used to reset the timer.

2. An automatic golf ball teeing up device for use by a golfer to automatically tee a golf ball, on a playing green having a foundation above a ground level, comprising:

an artificial turf coupled to the foundation;

a rectangular base plate having a top surface that lies below the foundation;

a circular cutout extending through the artificial turf, foundation, and rectangular base plate;

a chamber assembly having a vertical axis and a cylindrical chamber attached to the rectangular base plate having a loading chamber and retainer ring;

a holding cage for holding a plurality of golf balls therein;

a tube attached to the holding cage;

a pair of holding cylinders including a first and second holding cylinder, the first holding cylinder having a first solenoid valve, and second holding cylinder having a second solenoid valve, said holding cylinders bisect the tube and work opposite one another to allow one golf ball to pass at a time;

a pneumatic cylinder device axially aligned along the vertical axis of the chamber assembly within the cylindrical chamber, having a main cylinder substantially air tight and having an upper end and a lower end, having a piston rod and piston head mounted within the main cylinder, the piston rod having a top end, the piston head having a top side and a bottom side, the main cylinder having a down port extending outwardly from the upper end, and an up port extend outwardly from the lower end thereof, the down port being connected to the second solenoid valve, and the up port being connected to the first solenoid valve;

a tee attached to the top end of the piston rod; and a photoelectric sensor device having a photoelectric sensor having a photoelectric eye and a reflector, the photoelectric sensor in communication with a timer and a relay for electrically controlling the solenoid valves and the piston rod, the photoelectric eye being mounted to the foundation, the reflector being attached by a spring loaded hinge to the foundation, the photoelectric eye being aligned along an axis in communication with the reflector, the tee extending upwardly through the circular cutout along the axis between the photoelectric eye and the reflector.

3. The automatic golf ball teeing up device of claim 2, wherein the first and second solenoid valves control up and down movements of the holding cylinders by energizing and de-energizing and holding back the golf balls stacked within said tube and holding cage.

4. The automatic golf ball teeing up device of claim 3, wherein the photoelectric sensor is triggered when the photoelectric eye connects with the reflector and the timer is actuated to energize the first solenoid valve in the first holding cylinder to be pulled inwardly into the first holding cylinder in a down stroke, causing air pressure to increase on the top side of the piston head by traveling into the down port on the lower end of the main cylinder to force the piston head downwardly thereby withdrawing the piston rod into the main cylinder.

5. The automatic golf ball teeing up device of claim 4, wherein the timer counts for a plurality of seconds allowing one golf ball to roll from the tube onto the retainer ring, before the timer de-energizes the first solenoid valve and energizes the second solenoid valve thereby causing an up stroke position to be actuated by the first solenoid valve, while the second solenoid valve pushes downwardly into the second holding cylinder in a down stroke, the first solenoid valve is moved upwardly to hold back the golf balls.

6. The automatic golf ball teeing up device of claim 5, wherein once energized, the second solenoid valve causes air pressure to increase through the up port on the lower end of the main cylinder to the bottom side of the piston head, the piston head being raised thereby extending the piston rod upwardly through the circular cutout for teeing the golf ball.

7. The automatic golf ball teeing up device of claim 6, wherein the photoelectric sensor is disrupted when the photoelectric eye is disconnected from the reflector by the teed golf ball and the relay resets the timer.

8. The automatic golf ball teeing up device of claim 7, wherein the cylindrical chamber extends downwardly from the circular cutout perpendicular to the rectangular base plate.

9. The automatic golf ball teeing up device of claim 8, wherein the retainer ring holds one golf ball along the vertical axis prior to being teed up.

10. The automatic golf ball teeing up device of claim 9, wherein the holding cage has a bottom surface having an opening which rests against the foundation.

11. The automatic golf ball teeing up device of claim 10, wherein the tube is attached to the opening of the bottom surface of the holding cage.

12. The automatic golf ball teeing up device of claim 11, wherein the tube extends downwardly at an incline into the loading chamber of the cylindrical chamber for holding golf balls in a single file line to gravity feed the golf balls one at a time onto the retainer ring.

13. The automatic golf ball teeing up device of claim 12, further comprising a circular base cap for holding pneumatic cylinder device axially aligned along the vertical axis of the chamber assembly within the cylindrical chamber.

14. The automatic golf ball teeing up device of claim 13, wherein the piston rod is raised and lowered in a telescoping manner from within the main cylinder.

15. The automatic golf ball teeing up device of claim 14, wherein the down and up ports supply compressed air pressure to the top and bottom sides of the piston head within the main cylinder.

16. The automatic golf ball teeing up device of claim 15, further comprising a locknut for attaching the cylindrical chamber to the rectangular base plate.

17. The automatic golf ball teeing up device of claim 8, wherein a bolt and attaching nut, together with a coupling securely hold the tee on the top end of the piston rod.

18. A method of automatically teeing up a golf ball for use by a golfer using an automatic golf ball teeing up device having a holding cage attached to a tube, the tube feeding into a chamber assembly having a loading chamber and a retainer ring, having a photoelectric cylinder device having a photoelectric sensor having a photoelectric eye and a reflector in communication therewith, the chamber assembly having a piston rod, a piston head, and a main cylinder having an upper and lower end having an up and down port, the piston head having a top and bottom side, and the piston rod having a top end, having a tee connected to the top end of the piston rod, having a first and second solenoid valve within a first and second holding chamber, having a timer and a relay controlling the first and second solenoid valves which are connected to the down and up ports within the chamber assembly, having an up and down stroke position, the steps comprising:

actuating the down stroke position by triggering the photoelectric sensor by connecting the photoelectric eye with the reflector and actuating the timer which energizes the first solenoid valve in the first holding cylinder to be pulled inwardly into the first holding cylinder;

forcing the piston head downwardly thereby withdrawing the piston rod into the main cylinder by increasing air pressure on the top side of the piston head through the down port on the upper end of the main cylinder;

rolling the golf ball from the tube into the loading chamber and onto the retainer ring by having the timer count for a plurality of seconds;

actuating the up stroke position by the timer by energizing the second solenoid valve to push downwardly into the second holding cylinder for allowing golf balls within the tube to pass, and de-energizing the first solenoid valve by moving upwardly to hold the golf balls within the tube;

forcing the piston head upwardly thereby raising the piston rod from the main cylinder by increasing air pressure to the bottom side of the piston head through the up port on the lower end of the main cylinder; and triggering the relay to reset the timer by disrupting the photoelectric sensor by interrupting the connection between photoelectric eye and the reflector by having the teed up golf ball therebeween.

* * * * *